US009115587B2

(12) United States Patent
Zhang et al.

(10) Patent No.: US 9,115,587 B2
(45) Date of Patent: Aug. 25, 2015

(54) COOLING AIR CONFIGURATION IN A GAS TURBINE ENGINE

(75) Inventors: Jiping Zhang, Winter Springs, FL (US); Yan Yin, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 502 days.

(21) Appl. No.: 13/591,527

(22) Filed: Aug. 22, 2012

(65) Prior Publication Data

US 2014/0056686 A1 Feb. 27, 2014

(51) Int. Cl.
*F01D 5/08* (2006.01)
*F01D 5/18* (2006.01)

(52) U.S. Cl.
CPC ..... *F01D 5/087* (2013.01); *F01D 5/081* (2013.01); *F05D 2260/205* (2013.01)

(58) Field of Classification Search
CPC ..... F01D 5/081; F01D 5/082; F01D 5/085; F01D 5/087; F01D 25/12; F05D 2260/205
See application file for complete search history.

(56) References Cited

U.S. PATENT DOCUMENTS

| | | | | |
|---|---|---|---|---|
| 2,656,147 | A | | 10/1953 | Brownhill et al. |
| 2,906,494 | A | | 9/1959 | McCarty et al. |
| 3,575,528 | A | | 4/1971 | Beam, Jr. et al. |
| 3,742,706 | A | | 7/1973 | Klompas |
| 3,814,539 | A | | 6/1974 | Klompas |
| 3,945,758 | A | | 3/1976 | Lee |
| 3,982,852 | A | | 9/1976 | Andersen et al. |
| 4,021,138 | A | | 5/1977 | Scalzo et al. |
| 4,522,562 | A | | 6/1985 | Glowacki et al. |
| 4,730,982 | A | | 3/1988 | Kervistin |
| 4,820,116 | A | | 4/1989 | Hovan et al. |
| 4,882,902 | A | * | 11/1989 | Reigel et al. ..... 60/806 |
| 5,472,313 | A | | 12/1995 | Quinones et al. |
| 5,700,130 | A | | 12/1997 | Barbot et al. |
| 5,755,556 | A | | 5/1998 | Hultgren et al. |
| 5,758,487 | A | * | 6/1998 | Salt et al. ..... 60/806 |
| 5,795,130 | A | * | 8/1998 | Suenaga et al. ..... 416/95 |
| 5,984,636 | A | | 11/1999 | Fähndrich et al. |
| 6,007,299 | A | * | 12/1999 | Uematsu ..... 416/96 R |
| 6,053,701 | A | * | 4/2000 | Ichiryu et al. ..... 416/96 R |
| 6,095,751 | A | * | 8/2000 | Hirokawa et al. ..... 416/96 R |
| 6,540,477 | B2 | | 4/2003 | Glynn et al. |
| 6,551,056 | B2 | | 4/2003 | Rau |
| 6,837,676 | B2 | * | 1/2005 | Yuri et al. ..... 415/115 |
| 2012/0269615 | A1 | * | 10/2012 | Kuwabara ..... 415/116 |
| 2014/0056686 | A1 | * | 2/2014 | Zhang et al. ..... 415/1 |

FOREIGN PATENT DOCUMENTS

| | | | | |
|---|---|---|---|---|
| JP | 10121903 | A | * | 5/1998 ..... F01D 5/08 |

* cited by examiner

*Primary Examiner* — Edward Look
*Assistant Examiner* — Christopher R Legendre

(57) ABSTRACT

Cooling air is provided from a source of cooling air through a cooling air circuit in a turbine section of a gas turbine engine. A first portion of cooling air is provided from the source along a first path of the circuit to a plurality of blades associated with a stage of the turbine section. A second portion of cooling air is provided from the source along a second path of the circuit. The second path includes a turbine disc bore where the cooling air provides cooling to a radially innermost portion of at least one turbine disc that forms a part of a rotor of the engine. The second path is independent from the first path such that the second portion of cooling air bypasses the stage and is not mixed with the first portion of cooling air in the circuit after leaving the source.

19 Claims, 2 Drawing Sheets

COOLING AIR CONFIGURATION IN A GAS TURBINE ENGINE

FIELD OF THE INVENTION

The present invention relates to cooling air configurations in a gas turbine engine, wherein at least a portion of cooling air provided into a turbine section is provided into a turbine disc bore and bypasses an upstream turbine stage.

BACKGROUND OF THE INVENTION

In a turbomachine, such as a gas turbine engine, air is pressurized in a compressor section then mixed with fuel and burned in a combustion section to generate hot combustion gases. The hot combustion gases are expanded within a turbine section of the engine where energy is extracted to provide output power used to produce electricity. The hot combustion gases travel through a series of stages when passing through the turbine section. A stage typically includes a row of stationary airfoils, i.e., vanes, followed by a row of rotating airfoils, i.e., blades, where the blades extract energy from the hot combustion gases for providing output power.

SUMMARY OF THE INVENTION

In accordance with a first aspect of the present invention, a method is provided for providing cooling air from a source of cooling air through a cooling air circuit in a turbine section of a gas turbine engine. A first portion of cooling air is provided from the source of cooling air along a first path of the cooling air circuit to a plurality of blades associated with a stage of the turbine section. A second portion of cooling air is provided from the source of cooling air along a second path of the cooling air circuit. The second path includes a turbine disc bore where the cooling air provides cooling to a radially innermost portion of at least one turbine disc that forms a part of a rotor of the engine. The second path is independent from the first path such that the second portion of cooling air bypasses the stage and is not mixed with the first portion of cooling air in the cooling air circuit after leaving the source of cooling air.

In accordance with a second aspect of the present invention, a method is provided for providing cooling air from a source of cooling air through a cooling air circuit in a turbine section of a gas turbine engine. A first portion of cooling air is provided from the source of cooling air along a first path of the cooling air circuit to a plurality of blades associated with a first stage of the turbine section. A second portion of cooling air is provided from the source of cooling air along a second path of the cooling air circuit. The second path includes a turbine disc bore where the cooling air provides cooling to a radially innermost portion of at least one turbine disc that forms a part of a rotor of the engine. The second path is independent from the first path such that the second portion of cooling air bypasses the first stage and is not mixed with the first portion of cooling air in the cooling air circuit after leaving the source of cooling air. A third portion of cooling air is provided from the source of cooling air along a third path of the cooling air circuit to a plurality of blades associated with a second stage of the turbine section, the second stage being located downstream from the first stage with respect to a hot gas flowpath that is defined within the turbine section and that extends generally parallel to a longitudinal axis of the engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
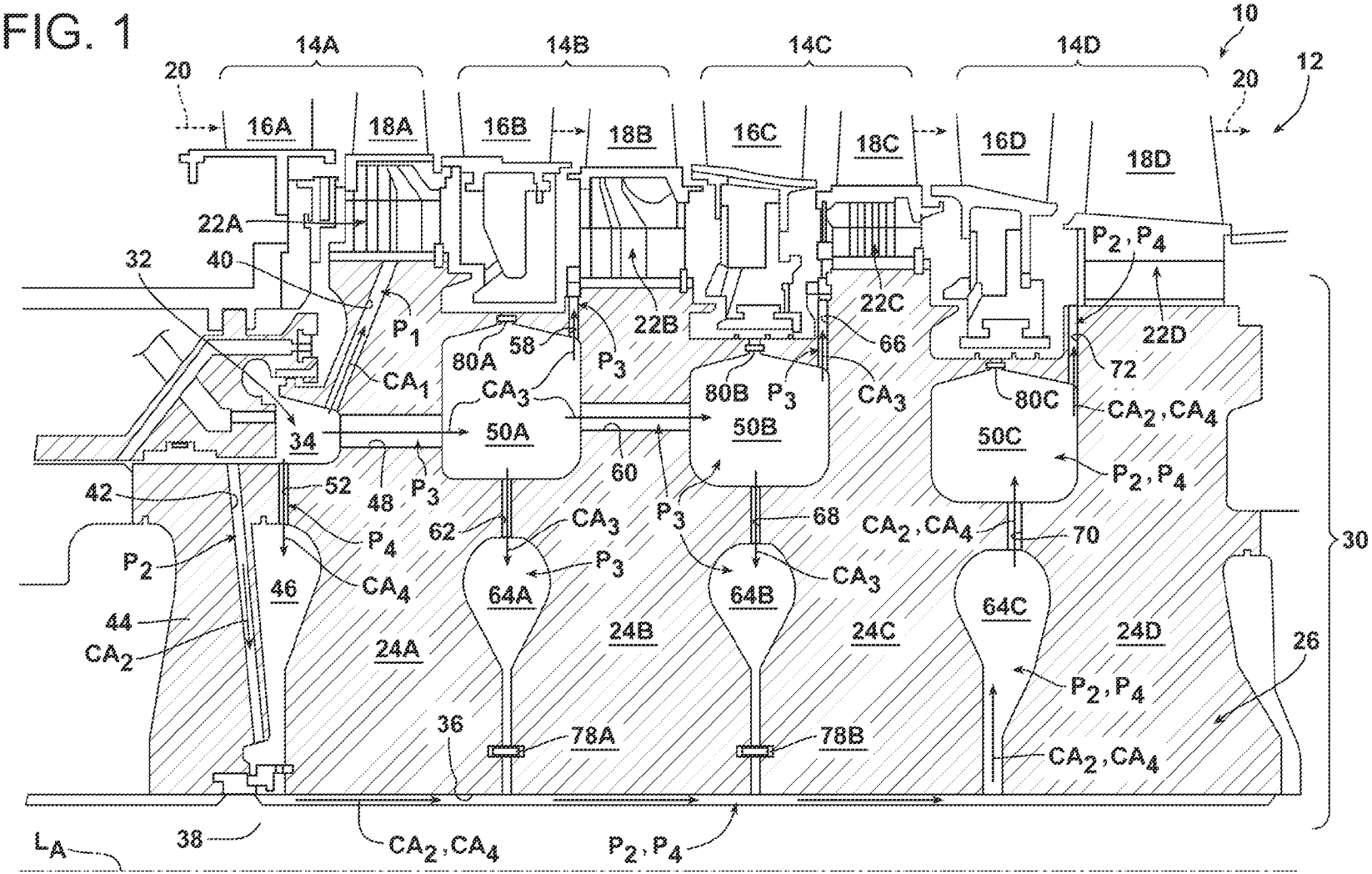
FIG. 1 is a schematic illustration, partially in cross section, of a portion of a turbine engine including a cooling air configuration according to an aspect of the present invention.

Referring to FIG. 1, a portion of a gas turbine engine 10 including an upper half of a turbine section 12 is schematically shown. The exemplary turbine section 12 illustrated in FIG. 1 includes first, second, third, and fourth stages 14A, 14B, 14C, 14D, wherein each stage 14A-D includes a row of stationary turbine vanes 16A-D and a row of rotating turbine blades 18A-D positioned downstream from each respective row of vanes 16A-D with respect to a direction of hot gas flow through a hot gas flowpath 20 defined within the turbine section 12 and extending generally parallel to a longitudinal axis $L_A$ of the engine 10. As shown in FIG. 1, each row of blades 18A-D is mounted to a respective blade disc structure 22A-D, which, in turn, is mounted to a respective turbine disc 24A-D, wherein turbine discs 24A-D each form a part of a rotor 26 of the engine 10. The term "blade disc structure" as used herein refers to any structure located between the blades and the turbine discs, including but not limited to, roots, platforms, disc attachments, etc.

Also shown in FIG. 1 is a cooling air circuit 30 constructed in accordance with an aspect of the present invention. Cooling air, which may comprise compressor discharge air, is provided into the cooling air circuit 30 from a source of cooling air 32 as will be described herein. The cooling air provided to the cooling air circuit 30 from the source of cooling air 32 may optionally be cooled in a conventional air cooler (not shown) before being provided to the source of cooling air 32, which, in the embodiment shown, comprises an annular source cavity 34 located radially between the hot gas flowpath 20 and a turbine disc bore 36 that forms part of the cooling air circuit 30. In the embodiment shown, the source cavity 34 is located directly radially inwardly from the first stage row of vanes 16A, and the turbine disc bore 36 is defined between the turbine discs 24A-D and a central, rotatable shaft 38 of the engine 10.

The cooling air circuit 30 according to this embodiment further comprises a first passage 40 that extends axially and radially outwardly from the source cavity 34 through the first turbine disc 24A to the blade disc structure 22A associated with the first stage row of blades 18A; a second passage 42 that extends axially and radially inwardly from the source cavity 34 through a seal disc 44 to a radially inner portion of an auxiliary cavity 46, wherein the radially inner portion of the auxiliary cavity 46 is located in close proximity to and is in fluid communication with the turbine disc bore 36; a third passage 48 that extends generally axially from the source cavity 34 through the first turbine disc 24A to a first cooling air cavity 50A located axially between the source cavity 34 and the second stage row of blades 18B; and a fourth passage 52 that extends generally radially inwardly from the source cavity 34 through a gap located between the seal disc 44 and the first turbine disc 24A to a radially outer portion of the auxiliary cavity 46. The auxiliary cavity 46 is defined between the seal disc 44 and the first turbine disc 24 and is located radially inwardly from the source cavity 34. It is noted that the second passage 42 could extend directly to the turbine disc bore 36 without departing from the scope and spirit of the invention.

The cooling air circuit 30 further comprises a fifth passage 58 that extends generally radially outwardly from the first cooling air cavity 50A through the second turbine disc 24B to the blade disc structure 22B associated with the second stage row of blades 18B; a sixth passage 60 that extends generally axially from the first cooling air cavity 50A through the second turbine disc 24B to a second cooling air cavity 50B located axially between the first cooling air cavity 50A and the third stage row of blades 18C; and a seventh passage 62 that extends generally radially inwardly from the first cooling air cavity 50A through a gap located between the first turbine disc 24A and the second turbine disc 24B to a first rotor disc cavity 64A that is defined between the first turbine disc 24A and the second turbine disc 24B and is located radially between the first cooling air cavity 50A and the turbine disc bore 36.

The cooling air circuit 30 still further comprises an eighth passage 66 that extends generally radially outwardly from the second cooling air cavity 50B through the third turbine disc 24C to the blade disc structure 22C associated with the third stage row of blades 18C; and a ninth passage 68 that extends generally radially inwardly from the second cooling air cavity 50B through a gap located between the second turbine disc 24B and the third turbine disc 24C to a second rotor disc cavity 64B that is defined between the second turbine disc 24B and the third turbine disc 24C and is located radially between the second cooling air cavity 50B and the turbine disc bore 36.

The cooling air circuit 30 also comprises a third rotor disc cavity 64C that is in fluid communication with the turbine disc bore 36 and is located radially between a third cooling air cavity 50C and the turbine disc bore 36; a tenth passage 70 that extends generally radially outwardly from the third rotor disc cavity 64C through a gap between the third turbine disc 24C and the fourth turbine disc 24D to the third cooling air cavity 50C of the cooling air circuit 30, which is located axially between the second cooling air cavity 50B and the fourth stage row of blades 18D; and an eleventh passage 72 that extends generally radially outwardly from the third cooling air cavity 50C through the fourth turbine disc 24D to the blade disc structure 22D associated with the fourth stage row of blades 18D.

Seals 78A, 78B are provided between the respective first and second rotor disc cavities 64A, 64B and the rotor disc bore 36 for substantially preventing leakage therebetween.

A method for providing cooling air from the source of cooling air 32, i.e., the source cavity 34 in the embodiment shown, through the cooling air circuit 30 will now be described.

A first portion $CA_1$ of cooling air is provided from the source cavity 34 along a first path $P_1$ of the cooling air circuit 30 to the first stage row of blades 18A, wherein the first stage 14A is also referred to herein as an upstream stage. The first path $P_1$ according to this embodiment comprises the first passage 40, which delivers the first portion $CA_1$ of cooling air to the first stage blade disc structure 22A, which in turn delivers the first portion $CA_1$ of cooling air to the first stage row of blades 18A. The first portion $CA_1$ of cooling air is used to cool the first stage row of blades 18A in any known manner and then may exit the first stage row of blades 18A and be swept up by the hot gas flowing through the hot gas flowpath 20. It is noted that the first stage blade disc structure 22A is schematically illustrated in FIG. 1 and could include any suitable configuration for delivering the first portion $CA_1$ of cooling air to the first stage row of blades 18A.

A second portion $CA_2$ of cooling air is provided from the source cavity 34 along a second path $P_2$ of the cooling air circuit 30. The second path $P_2$ according to this embodiment comprises the second passage 42, which delivers the second portion $CA_2$ of cooling air to the radially inner portion of the auxiliary cavity 46. The second portion $CA_2$ of cooling air then passes into the turbine disc bore 36 from the auxiliary cavity 46, although the second passage 42 could extend directly to the turbine disc bore 36 as noted above. The second path $P_2$ according to this embodiment further comprises the turbine disc bore 36, wherein the second portion $CA_2$ of cooling air provides cooling to radially innermost portions of the turbine discs 24A-D while passing through the turbine disc bore 36.

The second path $P_2$ according to this embodiment still further comprises the third rotor disc cavity 64C, the tenth passage 70, the third cooling fluid cavity 50C, and the eleventh passage 72. The eleventh passage 72 delivers the second portion $CA_2$ of cooling air to the fourth stage blade disc structure 22D, which in turn discharges the second portion $CA_2$ of cooling air to the hot gas flowpath 20, wherein the fourth stage 14D is also referred to herein as a downstream stage or a final stage. It is noted that the fourth stage blade disc structure 22D could deliver the second portion $CA_2$ of cooling air to the fourth stage row of blades 18D for cooling the fourth stage row of blades 18D in any known manner, wherein the second portion $CA_2$ of cooling air could then exit the fourth stage row of blades 18D and be swept up by the hot gas flowing through the hot gas flowpath 20.

According to this embodiment of the invention, the second path $P_2$ is independent from the first path $P_1$, such that the second portion $CA_2$ of cooling air bypasses the first stage 14A and is not mixed with the first portion $CA_1$ of cooling air in the cooling air circuit 30 after leaving the source cavity 34, although the first and second portions $CA_1$, $CA_2$ of cooling air may once again convene upon being swept up by the hot gas flowing through the hot gas flowpath 20. Hence, all of the cooling provided by the second portion $CA_2$ of cooling air is used to cool structure along the second path $P_2$) the fourth stage blade disc structure 22D, and, optionally, the fourth stage row of blades 18D.

A third portion $CA_3$ of cooling air is provided from the source cavity 34 along a third path $P_3$ of the cooling air circuit 30. The third path $P_3$ according to this embodiment comprises the third, fifth, sixth, seventh, eighth, and ninth passages 48, 58, 60, 62, 66, 68, the first and second cooling air cavities 50A, 50B, and the first and second rotor disc cavities 64A, 64B.

More specifically, the third passage 48 delivers the third portion $CA_3$ of cooling air from the source cavity 34 to the first cooling air cavity 50A. A first allotment of the third portion $CA_3$ of cooling air is provided to the second stage blade disc structure 22B via the fifth passage 58. The second stage blade disc structure 22B in turn delivers the first allotment of the third portion $CA_3$ of cooling air to the second stage row of blades 18B, wherein the second stage 14B is also referred to herein as an intermediate stage. The first allotment of the third portion $CA_3$ of cooling air is used to cool the second stage row of blades 18B in any known manner and then may exit the second stage row of blades 18B and be swept up by the hot gas flowing through the hot gas flowpath 20. It is noted that the second stage blade disc structure 22B is schematically illustrated in FIG. 1 and could include any suitable configuration for delivering the first allotment of the third portion $CA_3$ of cooling air to the second stage row of blades 18B.

A second allotment of the third portion $CA_3$ of cooling air is provided from the first cooling air cavity 50A to the second cooling air cavity 50B via the sixth passage 60. Some of the second allotment of the third portion $CA_3$ of cooling air is provided to the third stage blade disc structure 22C via the eighth passage 66. The third stage blade disc structure 22C in turn delivers this cooling air to the third stage row of blades 18C, wherein the third stage 14C is also referred to herein as an intermediate stage. This cooling air is used to cool the third stage row of blades 18C in any known manner and then may exit the third stage row of blades 18C and be swept up by the hot gas flowing through the hot gas flowpath 20. It is noted that the third stage blade disc structure 22C is schematically illustrated in FIG. 1 and could include any suitable configuration for delivering cooling air to the third stage row of blades 18C.

The remainder of the second allotment of the third portion $CA_3$ of cooling air in the second cooling air cavity 50B is provided into the second rotor disc cavity 64B via the ninth passage 68.

A third allotment of the third portion $CA_3$ of cooling air is provided from the first cooling air cavity 50A to the first rotor disc cavity 64A via the seventh passage 62.

According to this embodiment of the invention, the third path $P_3$ is independent from the first and second paths $P_1$, $P_2$, such that the third portion $CA_3$ of cooling air bypasses the first stage 14A and is not mixed with the first or second portions $CA_1$, $CA_2$ of cooling air in the cooling air circuit 30 after leaving the source cavity 34, although the first, second, and third portions $CA_1$, $CA_2$, $CA_3$ of cooling air may once again convene upon being swept up by the hot gas flowing through the hot gas flowpath 20. Hence, all of the cooling provided by the third portion $CA_3$ of cooling air is used to cool the structure along the third path $P_3$, the second and third stage blade disc structures 22B, 22C, and the second and third stage rows of blades 18B, 18C.

A fourth portion $CA_4$ of cooling air, also referred to herein as an auxiliary portion of cooling air, is provided from the source cavity 34 along a fourth path $P_4$ of the cooling air circuit 30, also referred to herein as an auxiliary path. The fourth path $P_4$ according to this embodiment comprises the fourth passage 52, which delivers the fourth portion $CA_4$ of cooling air to the radially outer portion of the auxiliary cavity 46. The fourth portion $CA_4$ of cooling air then passes through the auxiliary cavity 46 and is mixed with the second portion $CA_2$ of cooling air for entry into the turbine disc bore 36 with the second portion $CA_2$ of cooling air. The fourth path $P_4$ according to this embodiment further comprises the turbine disc bore 36, wherein the fourth portion $CA_4$ of cooling air, together with the second portion $CA_2$ of cooling air, provides cooling to the radially innermost portions of the turbine discs 24A-D while passing through the turbine disc bore 36.

The fourth path $P_4$ according to this embodiment still further comprises the third rotor disc cavity 64C, the tenth passage 70, the third cooling fluid cavity 50C, and the eleventh passage 72. The eleventh passage 72 delivers the fourth portion $CA_4$ of cooling air, together with the second portion $CA_2$ of cooling air, to the fourth stage blade disc structure 22D, which in turn discharges the second and fourth portions $CA_2$, $CA_4$ of cooling air to the hot gas flowpath 20, although the fourth stage blade disc structure 22D could deliver the second and fourth portions $CA_2$, $CA_4$ of cooling air to the fourth stage row of blades 18D for providing cooling thereto.

Figure 2:
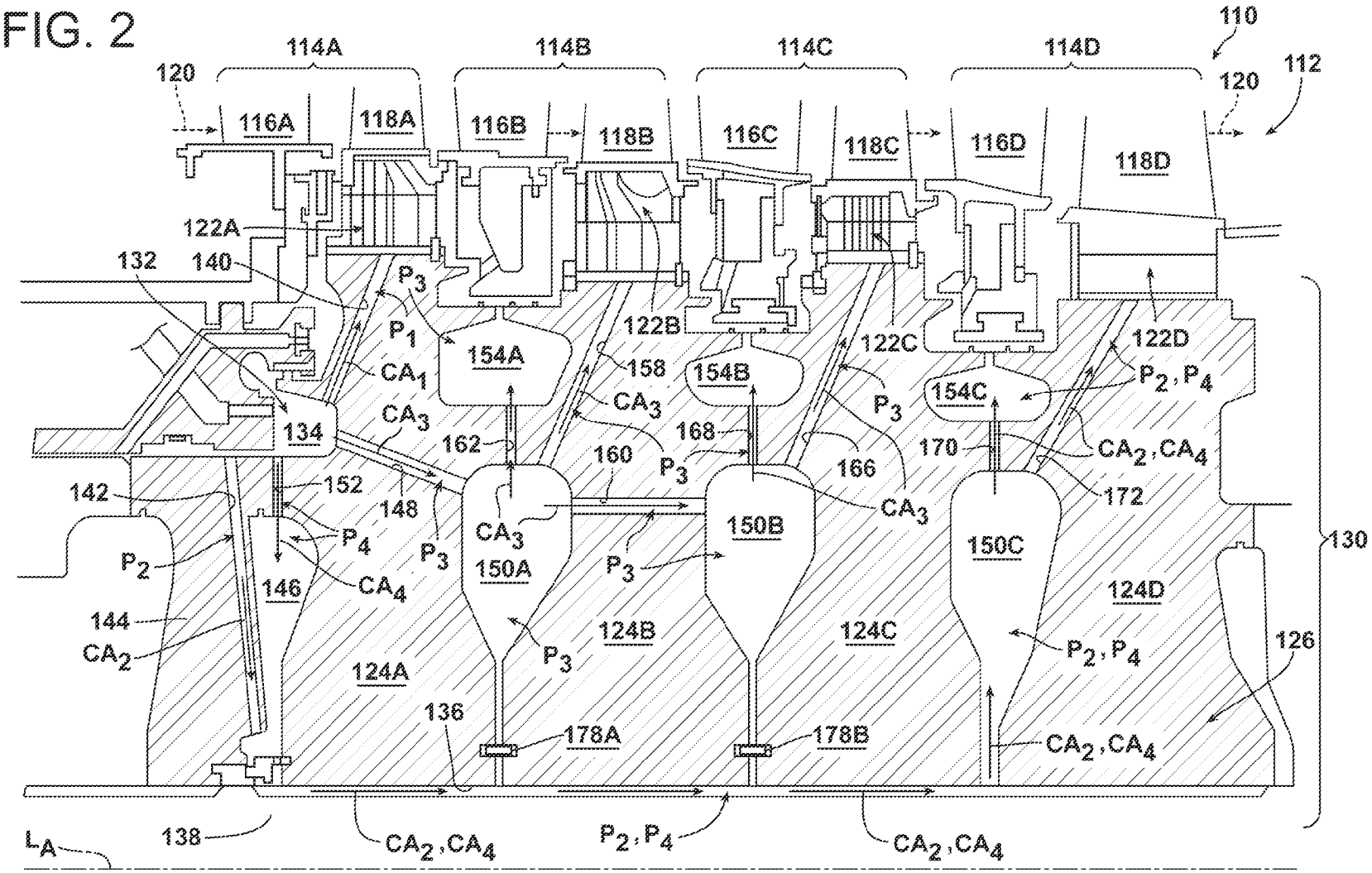
FIG. 2 is a schematic illustration, partially in cross section, of a portion of a turbine engine including a cooling air configuration according to another aspect of the present invention.

Referring now to FIG. 2, a portion of a gas turbine engine 110 including an upper half of a turbine section 112 is schematically shown. The exemplary turbine section 112 illustrated in FIG. 2 includes first, second, third, and fourth stages 114A, 114B, 114C, 114D, wherein each stage 114A-D includes a row of stationary turbine vanes 116A-D and a row of rotating turbine blades 118A-D positioned downstream from each respective row of vanes 116A-D with respect to a direction of hot gas flow through a hot gas flowpath 120 defined within the turbine section 12 and extending generally parallel to a longitudinal axis $L_A$ of the engine 110. As shown in FIG. 2, each row of blades 118A-D is mounted to a respective blade disc structure 122A-D, which, in turn, is mounted to a respective turbine disc 124A-D, wherein turbine discs 124A-D each form a part of a rotor 126 of the engine 110.

Also shown in FIG. 2 is a cooling air circuit 130 constructed in accordance with another aspect of the present invention. Cooling air, which may comprise compressor discharge air, is provided into the cooling air circuit 130 from a source of cooling air 132 as will be described herein. The cooling air provided to the cooling air circuit 130 from the source of cooling air 132 may optionally be cooled in a conventional air cooler (not shown) before being provided to the source of cooling air 132, which, in the embodiment shown, comprises an annular source cavity 134 located radially between the hot gas flowpath 120 and a turbine disc bore 136 that forms part of the cooling air circuit 130. In the embodiment shown, the source cavity 134 is located directly radially inwardly from the first stage row of vanes 116A, and the turbine disc bore 136 is defined between the turbine discs 124A-D and a central, rotatable shaft 138 of the engine 110.

The cooling air circuit 130 according to this embodiment further comprises a first passage 140 that extends axially and radially outwardly from the source cavity 134 through the first turbine disc 124A to the blade disc structure 122A associated with the first stage row of blades 118A; a second passage 142 that extends axially and radially inwardly from the source cavity 134 through a seal disc 144 to a radially inner portion of an auxiliary cavity 146, wherein the radially inner portion of the auxiliary cavity 146 is located in close proximity to and is in fluid communication with the turbine disc bore 136; a third passage 148 that extends axially and radially inwardly from the source cavity 134 through the first turbine disc 124A to a first rotor disc cavity 150A located radially between a first cooling air cavity 154A and the turbine disc bore 136; and a fourth passage 152 that extends generally radially inwardly from the source cavity 134 through a gap located between the seal disc 144 and the first turbine disc 124A to a radially outer portion of the auxiliary cavity 146. The auxiliary cavity 146 is defined between the seal disc 144 and the first turbine disc 124 and is located radially inwardly from the source cavity 134. It is noted that the second passage 142 could extend directly to the turbine disc bore 136 without departing from the scope and spirit of the invention.

The cooling air circuit 130 further comprises a fifth passage 158 that extends axially and radially outwardly from the first rotor disc cavity 150A through the second turbine disc 124B to the blade disc structure 122B associated with the second stage row of blades 118B; a sixth passage 160 that extends generally axially from the first rotor disc cavity 150A through the second turbine disc 124B to a second rotor disc cavity 150B located radially between a second cooling air cavity 154B and the turbine disc bore 136; and a seventh passage 162 that extends generally radially outwardly from the first rotor disc cavity 150A through a gap located between the first turbine disc 124A and the second turbine disc 124B to the first cooling air cavity 154A, which is defined between the first turbine disc 124A and the second turbine disc 124B and is located axially between the source cavity 134 and the second stage row of blades 118B.

The cooling air circuit 130 still further comprises an eighth passage 166 that extends axially and radially outwardly from the second rotor disc cavity 150B through the third turbine disc 124C to the blade disc structure 122C associated with the third stage row of blades 118C; and a ninth passage 168 that extends generally radially outwardly from the second rotor disc cavity 150B through a gap located between the second turbine disc 124B and the third turbine disc 124C to the second cooling air cavity 154B, which is defined between the second turbine disc 124B and the third turbine disc 124C and is located axially between the first cooling air cavity 154A and the third stage row of blades 118C.

The cooling air circuit 130 also comprises a third rotor disc cavity 150C that is in fluid communication with the turbine disc bore 136 and is located radially between a third cooling air cavity 154C and the turbine disc bore 136; a tenth passage 170 that extends generally radially outwardly from the third rotor disc cavity 150C through a gap between the third turbine disc 124C and the fourth turbine disc 124D to the third cooling air cavity 154C of the cooling air circuit 130, which is located axially between the second cooling air cavity 154B and the fourth stage row of blades 118D; and an eleventh passage 172 that extends axially and radially outwardly from the third rotor disc cavity 150C through the fourth turbine disc 124D to the blade disc structure 122D associated with the fourth stage row of blades 118D.

Seals 178A, 178B are provided between the respective first and second rotor disc cavities 150A, 150B and the rotor disc bore 136 for substantially preventing leakage therebetween.

A method for providing cooling air from the source of cooling air 132, i.e., the source cavity 134 in the embodiment shown, through the cooling air circuit 130 will now be described.

A first portion $CA_1$ of cooling air is provided from the source cavity 134 along a first path $P_1$ of the cooling air circuit 130 to the first stage row of blades 118A, wherein the first stage 114A is also referred to herein as an upstream stage. The first path $P_1$ according to this embodiment comprises the first passage 140, which delivers the first portion $CA_1$ of cooling air to the first stage blade disc structure 122A. The first stage blade disc structure 122A in turn delivers the first portion $CA_1$ of cooling air to the first stage row of blades 118A. The first portion $CA_1$ of cooling air is used to cool the first stage row of blades 118A in any known manner and then may exit the first stage row of blades 118A and be swept up by the hot gas flowing through the hot gas flowpath 120. It is noted that the first stage blade disc structure 122A is schematically illustrated in FIG. 2 and could include any suitable configuration for delivering the first portion $CA_1$ of cooling air to the first stage row of blades 118A.

A second portion $CA_2$ of cooling air is provided from the source cavity 134 along a second path $P_2$ of the cooling air circuit 130. The second path $P_2$ according to this embodiment comprises the second passage 142, which delivers the second portion $CA_2$ of cooling air to the radially inner portion of the auxiliary cavity 146. The second portion $CA_2$ of cooling air then passes into the turbine disc bore 136 from the auxiliary cavity 146, although the second passage 142 could extend directly to the turbine disc bore 136 as noted above. The second path $P_2$ according to this embodiment further comprises the turbine disc bore 136, wherein the second portion $CA_2$ of cooling air provides cooling to radially innermost portions of the turbine discs 124A-D while passing through the turbine disc bore 136.

The second path $P_2$ according to this embodiment still further comprises the third rotor disc cavity 150C, the tenth passage 170, the third cooling fluid cavity 154C, and the eleventh passage 172. The tenth passage 170 delivers some of the second portion $CA_2$ of cooling air from the third rotor disc cavity 150C to the third cooling fluid cavity 154C. The eleventh passage 172 delivers the remainder of the second portion $CA_2$ of cooling air from the third rotor disc cavity 150C to the fourth stage blade disc structure 122D, which in turn discharges the second portion $CA_2$ of cooling air to the hot gas flowpath 120, wherein the fourth stage 114D is also referred to herein as a downstream stage or a final stage. It is noted that the fourth stage blade disc structure 122D could deliver the second portion $CA_2$ of cooling air to the fourth stage row of blades 118D for cooling the fourth stage row of blades 118D in any known manner, wherein the second portion $CA_2$ of cooling air could then exit the fourth stage row of blades 118D and be swept up by the hot gas flowing through the hot gas flowpath 120.

According to this embodiment of the invention, the second path $P_2$ is independent from the first path $P_1$, such that the second portion $CA_2$ of cooling air bypasses the first stage 114A and is not mixed with the first portion $CA_1$ of cooling air in the cooling air circuit 130 after leaving the source cavity 134, although the first and second portions $CA_1$, $CA_2$ of cooling air may once again convene upon being swept up by the hot gas flowing through the hot gas flowpath 120. Hence, all of the cooling provided by the second portion $CA_2$ of cooling air is used to cool structure along the second path $P_2$, the fourth stage blade disc structure 122D, and, optionally, the fourth stage row of blades 118D.

A third portion $CA_3$ of cooling air is provided from the source cavity 134 along a third path $P_3$ of the cooling air circuit 130. The third path $P_3$ according to this embodiment comprises the third, fifth, sixth, seventh, eighth, and ninth passages 148, 158, 160, 162, 166, 168, the first and second rotor disc cavities 150A, 150B, and the first and second cooling air cavities 154A, 154B.

More specifically, the third passage 148 delivers the third portion $CA_3$ of cooling air from the source cavity 134 to the first rotor disc cavity 150A. A first allotment of the third portion $CA_3$ of cooling air is provided to the second stage blade disc structure 122B via the fifth passage 158. The second stage blade disc structure 122B in turn delivers the first allotment of the third portion $CA_2$ of cooling air to the second stage row of blades 118B, wherein the second stage 114B is also referred to herein as an intermediate stage. The first allotment of the third portion $CA_3$ of cooling air is used to cool the second stage row of blades 118B in any known manner and then may exit the second stage row of blades 118B and be swept up by the hot gas flowing through the hot gas flowpath 120. It is noted that the second stage blade disc structure 122B is schematically illustrated in FIG. 2 and could include any suitable configuration for delivering the first allotment of the third portion $CA_3$ of cooling air to the second stage row of blades 118B.

A second allotment of the third portion $CA_3$ of cooling air is provided from the first rotor disc cavity 150A to the second rotor disc cavity 150B via the sixth passage 160. Some of the second allotment of the third portion $CA_3$ of cooling air is provided to the third stage blade disc structure 122C via the eighth passage 166. The third stage blade disc structure 122C in turn delivers this cooling air to the third stage row of blades 118C, wherein the third stage 114C is also referred to herein as an intermediate stage. This cooling air is used to cool the third stage row of blades 118C in any known manner and then may exit the third stage row of blades 118C and be swept up by the hot gas flowing through the hot gas flowpath 120. It is noted that the third stage blade disc structure 122C is schematically illustrated in FIG. 2 and could include any suitable configuration for delivering cooling air to the third stage row of blades 118C.

The remainder of the second allotment of the third portion $CA_3$ of cooling air in the second rotor disc cavity 150B is provided into the second cooling air cavity 154B via the ninth passage 168.

A third allotment of the third portion $CA_3$ of cooling air is provided from the first rotor disc cavity 150A to the first cooling air cavity 154A via the seventh passage 162.

According to this embodiment of the invention, the third path $P_3$ is independent from the first and second paths $P_1$, $P_2$, such that the third portion $CA_3$ of cooling air bypasses the first stage 114A and is not mixed with the first or second portions $CA_1$, $CA_2$ of cooling air in the cooling air circuit 130 after leaving the source cavity 134, although the first, second, and third portions $CA_1$, $CA_2$, $CA_3$ of cooling air may once again convene upon being swept up by the hot gas flowing through the hot gas flowpath 120. Hence, all of the cooling provided by the third portion $CA_3$ of cooling air is used to cool structure along the third path $P_3$, the second and third stage blade disc structures 122B, 122C, and the second and third stage rows of blades 118B, 118C.

A fourth portion $CA_4$ of cooling air, also referred to herein as an auxiliary portion of cooling air, is provided from the source cavity 134 along a fourth path $P_4$ of the cooling air circuit 130, also referred to herein as an auxiliary path. The fourth path $P_4$ according to this embodiment comprises the fourth passage 152, which delivers the fourth portion $CA_4$ of cooling air to the radially outer portion of the auxiliary cavity 146, wherein the fourth portion $CA_4$ of cooling air then passes through the auxiliary cavity 146 and is mixed with the second portion $CA_2$ of cooling air for entry into the turbine disc bore 136 with the second portion $CA_2$ of cooling air. The fourth path $P_4$ according to this embodiment further comprises the turbine disc bore 136, wherein the fourth portion $CA_4$ of cooling air, together with the second portion $CA_2$ of cooling air, provides cooling to the radially innermost portions of the turbine discs 124A-D while passing through the turbine disc bore 136.

The fourth path $P_4$ according to this embodiment still further comprises the third rotor disc cavity 150C, the tenth passage 170, the third cooling fluid cavity 154C, and the eleventh passage 172. The eleventh passage 172 delivers some of the fourth portion $CA_4$ of cooling air, together with some of the second portion $CA_2$ of cooling air, to the fourth stage blade disc structure 122D, which in turn discharges this cooling air to the hot gas flowpath 120, although the fourth stage blade disc structure 122D could deliver this cooling air to the fourth stage row of blades 118D for providing cooling thereto.

According to the present invention, it is believed that adequate cooling is provided to the radially innermost portions of at least the first, second, and third turbine discs 24A-C (FIG. 1) and 124A-C (FIG. 2) so as to reduce thermal stresses experienced by these components and other components in and around the turbine disc bore 36 (FIG. 1) and 136 (FIG. 2). Such reduction of thermal stresses is believed to effect an increase of the useful lifespan of these components.

Additionally, in the configuration disclosed in FIG. 2, belly band seals 80A, 80B, 80C, which are provided for sealing the cooling air cavities 50A-C in the embodiment of FIG. 1, can be removed. Specifically, these seals 80A-C are not required in the configuration illustrated in FIG. 2, as these seals 80A-C are provided in FIG. 1 to ensure that adequate cooling air is provided to the respective rows of blades 18A-C. Since the cooling air provided to the rows of blades 118A-C illustrated in FIG. 2 is provided directly from the rotor disc cavities 150A-C, the amount of cooling air provided to the rows of blades 118A-C can be controlled by changing the diameters of the passages that extend between the rotor disc cavities 150A-C and the cooling air cavities 154A-C.

Further, it is noted that the dimensions and directions of the passages and cavities illustrated in FIGS. 1 and 2 and described herein are exemplary, and the present invention is not intended to be limited to the dimensions and directions illustrated and described.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for providing cooling air from a source of cooling air through a cooling air circuit in a turbine section of a gas turbine engine, the method comprising:

providing a first portion of cooling air from the source of cooling air along a first path of the cooling air circuit to a plurality of blades associated with an upstream stage of the turbine section;

providing a second portion of cooling air from the source of cooling air along a second path of the cooling air circuit, the second path including a turbine disc bore where the cooling air provides cooling to a radially innermost portion of at least one turbine disc that forms a part of a rotor of the engine, wherein the second path is independent from the first path such that the second portion of cooling air bypasses the upstream stage and is not mixed with the first portion of cooling air in the cooling air circuit after leaving the source of cooling air; and providing a third portion of cooling air from the source of cooling air along a third path of the cooling air circuit to a plurality of blades associated with an intermediate stage of the turbine section, the intermediate stage being downstream from the upstream stage with respect to a hot gas flowpath that is defined within the turbine section and that extends generally parallel to a longitudinal axis of the engine;

wherein the third path is independent from the first and second paths such that the third portion of cooling air bypasses the upstream stage and is not mixed with the first or second portions of cooling air in the cooling air circuit after leaving the source of cooling air.

2. The method according to claim 1, wherein, after passing through the turbine disc bore, the second portion of cooling air is provided to blade disc structure associated with a downstream stage of the turbine section, the downstream stage being downstream from the upstream stage with respect to the hot gas flowpath.

3. The method according to claim 1, wherein the third path includes a first cooling air cavity located axially between the source of cooling air and the blades associated with the intermediate stage.

4. The method according to claim 3, wherein:

the upstream stage comprises a first stage;

the intermediate stage comprises a second stage;

a first allotment of the cooling air in the first cooling air cavity is provided to the blades associated with the second stage;

a second allotment of the cooling air in the first cooling air cavity is provided to a second cooling air cavity for delivery to a plurality of blades associated with a third stage; and a third allotment of the cooling air in the first cooling air cavity is provided to a rotor disc cavity located radially between the first cooling air cavity and the turbine disc bore.

5. The method according to claim 1, wherein the third path includes a first rotor disc cavity located axially between the source of cooling air and the blades associated with the intermediate stage.

6. The method according to claim 5, wherein:

the upstream stage comprises a first stage;

the intermediate stage comprises a second stage;

a first allotment of the cooling air in the first rotor disc cavity is provided to the blades associated with the second stage;

a second allotment of the cooling air in the first rotor disc cavity is provided to a second rotor disc cavity for delivery to a plurality of blades associated with a third stage; and a third allotment of the cooling air in the first rotor disc cavity is provided to a cooling air cavity located radially between the first rotor disc cavity and the hot gas path.

7. The method according to claim 1, wherein the source of cooling air comprises a source cavity located radially between the turbine disc bore and the hot gas flowpath.

8. The method according to claim 7, wherein the source cavity is located directly radially inwardly from a row of turbine vanes associated with a first stage in the turbine section.

9. The method according to claim 1, further comprising providing an auxiliary portion of cooling air from the source of cooling air along an auxiliary path of the cooling air circuit, the auxiliary path including an auxiliary cavity and the turbine disc bore, wherein the auxiliary cavity is located radially inwardly from the source of cooling air, and wherein the auxiliary portion of cooling air flows through the turbine disc bore with the second portion of cooling air.

10. A method for providing cooling air from a source of cooling air through a cooling air circuit in a turbine section of a gas turbine engine, the method comprising:

providing a first portion of cooling air from the source of cooling air along a first path of the cooling air circuit to an upstream stage of the turbine section;

providing a second portion of cooling air from the source of cooling air along a second path of the cooling air circuit, the second path including a turbine disc bore where the cooling air provides cooling to at least one turbine disc that forms a part of a rotor of the engine, wherein the second path is independent from the first path such that the second portion of cooling air bypasses the upstream stage and is not mixed with the first portion of cooling air in the cooling air circuit after leaving the source of cooling air; and providing a third portion of cooling air from the source of cooling air along a third path of the cooling air circuit to downstream stage of the turbine section, the downstream stage being located downstream from the upstream stage with respect to a hot gas flowpath that is defined within the turbine section and that extends generally parallel to a longitudinal axis of the engine, wherein the third path is independent from the first and second paths such that the third portion of cooling air bypasses the upstream stage and is not mixed with the first or second portions of cooling air in the cooling air circuit after leaving the source of cooling air.

11. The method according to claim 10, wherein:

the third path includes a first cooling air cavity located axially between the source of cooling air and blades associated with the downstream stage;

a first allotment of the cooling air in the first cooling air cavity is provided to the blades associated with the downstream stage;

a second allotment of the cooling air in the first cooling air cavity is provided to a second cooling air cavity for delivery to a plurality of blades associated with a further downstream stage; and a third allotment of the cooling air in the first cooling air cavity is provided to a rotor disc cavity located radially between the first cooling air cavity and the turbine disc bore.

12. The method according to claim 11, wherein the upstream stage comprises a first stage, the downstream stage comprises a second stage, and the further downstream stage comprises a third stage.

13. The method according to claim 12, wherein, after passing through the turbine disc bore, the second portion of cooling air is provided to blade disc structure associated with a final stage of the turbine section, the final stage being downstream from the first, second, and third stages with respect to the hot gas flowpath.

14. The method according to claim 10, wherein:

the third path includes a first rotor disc cavity located axially between the source of cooling air and blades associated with the downstream stage;

a first allotment of the cooling air in the first rotor disc cavity is provided to the blades associated with the downstream stage;

a second allotment of the cooling air in the first rotor disc cavity is provided to a second rotor disc cavity for delivery to a plurality of blades associated with a further downstream stage; and a third allotment of the cooling air in the first rotor disc cavity is provided to a cooling air cavity located radially between the first rotor disc cavity and the hot gas path.

15. The method according to claim 14, wherein, after passing through the turbine disc bore, the second portion of cooling air is provided to blade disc structure associated with a final stage of the turbine section, the final stage being downstream from the upstream, downstream, and further downstream stages with respect to the hot gas flowpath.

16. The method according to claim 15, further comprising providing an auxiliary portion of cooling air from the source of cooling air along an auxiliary path of the cooling air circuit, the auxiliary path including an auxiliary cavity and the turbine disc bore, wherein the auxiliary cavity is located radially inwardly from the source of cooling air.

17. The method according to claim 16, wherein the auxiliary portion of cooling air flows through the turbine disc bore and to the blade disc structure associated with the final stage of the turbine section with the second portion of cooling air.

18. The method according to claim 10, wherein the source cavity is located directly radially inwardly from a row of turbine vanes associated with the upstream stage in the turbine section.

19. The method according to claim 10, wherein the first portion of cooling air is provided to a plurality of blades associated with the upstream stage, the second portion of cooling air provides cooling to a radially innermost portion of the at least one turbine disc, and the third portion of cooling air is provided to a plurality of blades associated with the downstream stage.

* * * * *